US008475204B2

(12) United States Patent
Blasick et al.

(10) Patent No.: US 8,475,204 B2
(45) Date of Patent: Jul. 2, 2013

(54) ELECTRICAL CONNECTOR HAVING SHAPED DIELECTRIC INSERT FOR CONTROLLING IMPEDANCE

(75) Inventors: Francis J. Blasick, Halifax, PA (US); Keith Richard Foltz, Duncannon, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 16 days.

(21) Appl. No.: 12/874,970

(22) Filed: Sep. 2, 2010

(65) Prior Publication Data

US 2012/0058672 A1 Mar. 8, 2012

(51) Int. Cl.
*H01R 9/05* (2006.01)

(52) U.S. Cl.
USPC ..... 439/578; 439/584

(58) Field of Classification Search
USPC ..... 439/578–585
See application file for complete search history.

(56) References Cited

U.S. PATENT DOCUMENTS 4,408,822 A * 10/1983 Nikitas ..... 439/583
4,431,255 A * 2/1984 Banning ..... 439/578
5,563,562 A 10/1996 Szwec
5,696,474 A 12/1997 Spivey et al.
6,604,949 B2 8/2003 Oldfield
6,709,289 B2 3/2004 Huber et al.
6,869,316 B2 * 3/2005 Hinkle et al. ..... 439/675
7,011,529 B2 3/2006 Oldfield et al.
7,048,579 B2 * 5/2006 Montena ..... 439/578
7,077,700 B2 * 7/2006 Henningsen ..... 439/583
7,094,971 B2 8/2006 Johnsen
7,165,974 B2 * 1/2007 Kooiman ..... 439/63
7,168,979 B2 1/2007 Cassanego et al.
7,455,550 B1 11/2008 Sykes
7,798,848 B2 * 9/2010 Islam ..... 439/578
7,931,499 B2 * 4/2011 Islam ..... 439/584

OTHER PUBLICATIONS

BNC Specifications to MIL-C-39012 (IEC 169-8); Spectrum Elektrotechnik GmbH, Apr. 1998, 4 pgs.

* cited by examiner

*Primary Examiner* — Thanh Tam Le

(57) ABSTRACT

Electrical connector that includes a connector housing having mating and terminating ends. The connector housing has a housing cavity and a leading edge at the mating end that defines an opening to the housing cavity. A central axis extends through the housing cavity between the mating and terminating ends. The electrical connector also includes a dielectric insert within the housing cavity and an electrical contact that is held by the insert along the central axis. The insert has a recess surface that faces the mating end and extends a radial distance, outward from the electrical contact. The insert includes a dielectric rim that projects from the recess surface toward the mating end. The dielectric rim surrounds: and is radially spaced from at least a portion of the electrical contact. The dielectric rim and the recess surface define an impedance-control space that surrounds at least the portion of the electrical contact.

21 Claims, 6 Drawing Sheets

ELECTRICAL CONNECTOR HAVING SHAPED DIELECTRIC INSERT FOR CONTROLLING IMPEDANCE

BACKGROUND OF THE INVENTION

The subject matter herein relates generally to electrical connectors and more particularly, to coaxial connectors that are configured to have a predetermined impedance.

In some connector assemblies in which two connectors mate with each other, it is desirable to match impedances of the two connectors to reduce unwanted signal reflections. For example, Bayonet Neill-Concelman (BNC) connectors are typically offered as having impedances with 50 ohms or 75 ohms. The conventional 50-ohm BNC connector is described in standards MIL-STD-348A or MIL-C-39012 (IEC 169-8). The conventional 50-ohm BNC connector has a connector housing and a dielectric insert disposed therein. The dielectric insert has an engagement end that is configured to interface with a coupling connector. An electrical contact extends through a center of the dielectric insert and has a socket located at the engagement end of the dielectric insert. The socket is configured to mate with a mating pin contact of the coupling connector. In the conventional. 50-ohm BNC connector, the dielectric insert has a neck that immediately surrounds the socket of the electrical contact in order to provide mechanical support for the socket. The dielectric insert in the 50-ohm BNC connector may be shaped at portions other than the engagement end to provide a desired impedance for the connector. For example, a rear end of the dielectric insert or a mid-portion located between the engagement and rear ends may be shaped with respect to the connector housing and the electrical contact to provide an air dielectric to achieve a desired impedance.

Conventional 75-ohm BNC connectors may also include a neck that immediately surrounds the socket of the electrical contact in order to provide mechanical support. Also, the engagement end of other conventional 75-ohm connectors may have a planar surface that extends perpendicular to an axis of the electrical contact. Similar to the 50-ohm BNC connector, other portions of the dielectric insert beside the engagement end may be shaped to provide ail air dielectric to achieve the desired impedance.

However, existing methods for controlling impedance in electrical connectors, such as the methods described above with respect to 50-ohm and 75-ohm BNC connectors, have limited effectiveness in, obtaining a desired impedance for the electrical connectors at the engagement end/interface. Accordingly, there is, a need for electrical connectors having a desired impedance and for methods of controlling impedance in electrical connectors.

BRIEF DESCRIPTION OF THE INVENTION

In one embodiment, an electrical connector is provided that includes a connector housing having mating and terminating ends. The connector housing has a housing cavity and a leading edge at the mating end that defines an opening to the housing cavity. A central axis extends through the housing cavity between the mating and terminating ends. The electrical connector also includes a dielectric insert that is positioned within the housing cavity and an electrical contact that is held by the insert along the central axis. The electrical contact is configured to engage a coupling connector when inserted through the opening into the housing cavity. The insert has a recess surface that faces the mating end and extends a radial distance outward from the electrical contact.

The insert includes a dielectric rim that projects from the recess surface toward the mating end. The dielectric rim surrounds and is radially spaced from at least a portion of the electrical contact. The dielectric rim and the recess surface define an impedance-control space that surrounds at least the portion of the electrical contact.

In another embodiment, an electrical connector is provided that includes a connector housing having mating and terminating ends. The connector housing has an opening at the mating end that leads into a housing cavity. A central axis extends through the housing cavity between the mating and terminating ends. The electrical connector also includes a contact sub-assembly that is disposed within the housing cavity. The contact sub-assembly includes a dielectric insert that has a dielectric material and also includes an electrical contact held by the insert along the central axis. The contact sub-assembly has an engagement end configured to interface with a coupling connector. The electrical contact projects beyond the insert at the engagement end. A cross-section of the contact sub-assembly taken perpendicular to the central axis at the engagement end is configured for a predetermined impedance. The electrical contact is immediately surrounded by an impedance-control space at the engagement end. The impedance-control space is surrounded and defined by the dielectric material of the insert.

DETAILED DESCRIPTION OF THE INVENTION

Figure 1:
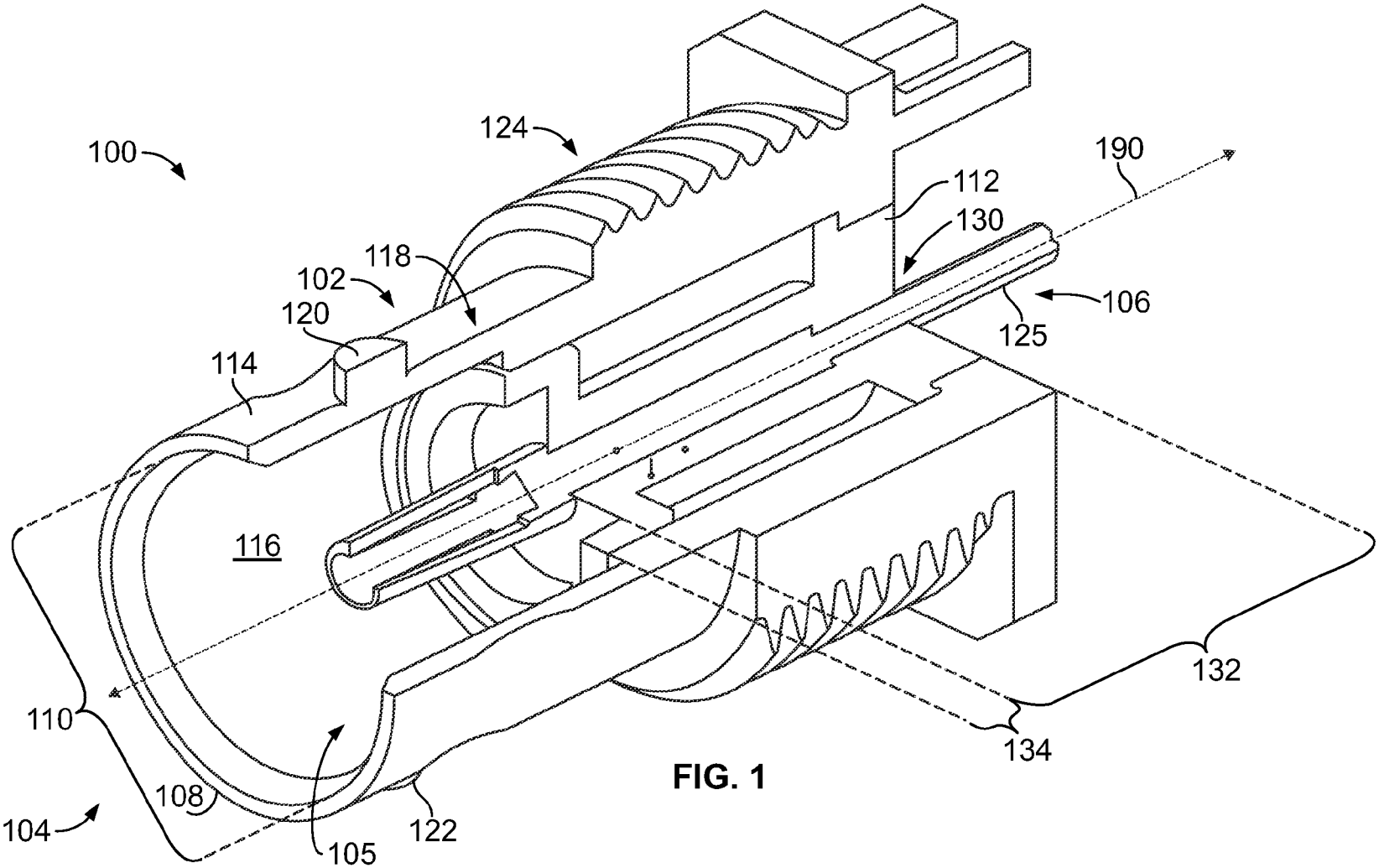
FIG. 1 is an exposed perspective view of an electrical connector formed in accordance with one embodiment.

FIG. 1 is an exposed perspective view of an electrical connector 100 formed in accordance with one embodiment. For illustrative purposes, a quarter section of the electrical connector 100 has been removed in FIG. 1. The electrical connector 100 may include;a connector housing 102 that has a mating end 104 and a terminating end 106. The mating end 104 is configured to engage a coupling connector 300 (shown in FIG. 3) during a mating operation, and the terminating end 106 is configured to engage a communication cable (not shown), such as a coaxial cable. As shown, the connector housing 102 has a housing cavity 105 and a leading edge 108 at the mating end 104 that defines an opening 110 to the housing cavity 105. A central axis 190 extends through the housing cavity 105 between the mating and terminating ends 104 and 106.

The electrical connector 100 also includes a dielectric insert 112 that is positioned within the housing cavity 105 and held by the connector housing 102. The electrical connector 100 may also include an electrical contact 125 that is held by the insert 112 along the central axis 190. More specifically, the central axis 190 may extend along a length of the electrical contact 125 through a center of the electrical contact 125. The electrical contact 125 may be configured to engage a mating contact 302 (shown in FIG. 3) of the coupling connector 300 during the mating operation. In the illustrated embodiment, the mating and terminating ends 104 and 106 may, be opposite from each other on the central axis 190. However, in alternative embodiments, the electrical connector 100 may be a right-angle connector or have another geometry in which the mating and terminating ends 104 and 106 are not located opposite each other on the central axis 190.

The connector housing 102 may include a conductive housing material. For example, the connector housing 102 may comprise a metal alloy or, as another example, may comprise a plastic material having conductive fibers distributed throughout. As shown in FIG. 1, the connector housing 102 may include a sidewall 114 that surrounds or extends about the central axis 190. The sidewall 114 has an interior surface 116 that faces radially inward toward the central axis 190, and an exterior surface 118 that faces radially outward away from the central axis 190. The interior surface 116 may define at least a portion of the housing cavity 105. The sidewall 114 may also have various features or elements coupled to the connector housing 102 along the exterior surface 118. For example, the various features or elements may be formed from the housing material of the connector housing 102 or may be separate parts that are attached to the connector housing 102. The features or elements may include key members 120 and 122 that are located proximate to the mating end 104. The key members 120 and 122 may be shaped to complement cavities or recesses (not shown) of the coupling connector 300 and facilitate aligning the coupling and electrical connectors 300 and 100 during the mating operation. Other features or elements of the connector housing 102 may include threads 124 that encircle the central axis 190 along the exterior surface 118. The threads 124 may engage corresponding threads (not shown) of a panel or other support structure (not shown).

In the illustrated embodiment, the sidewall 114 is a continuous sidewall that encircles the central axis 190. However, in alternative embodiments, the sidewall 114 is not continuous and may comprise separate parts that couple to each other. Furthermore, the sidewall 114 may have other shapes when viewed along the central axis 190 instead of a circle. For example, the sidewall 114 may be rectangular or square-shaped and include planar wall sections.

The insert 112 and the electrical contact 125 may form a contact sub-assembly 130 of the electrical connector 100. The insert 112 may comprise a dielectric material. The dielectric material of the insert 112 may be conductively different with respect to the housing material of the connector housing 102. For example, the insert 112 may comprise polytetrafluoroethylene (PTFE) or may be molded from nylon-type material, or thermoplastic polymers. As another, specific example, polymethylpentene may be used to form the insert 112. The insert 112 may be shaped during a molding process or the insert 112 may be subsequently shaped through, for example, a machining process (e.g., screw-machining). As shown, the insert 112 includes a contact bore 132 having the central axis 190 extend therethrough. The Contact bore 132 is sized and shaped to receive and hold the electrical contact 125.

The insert 112 may be shaped to facilitate controlling an impedance of the electrical connector 100. For example, the insert 112 may be shaped to include a first impedance-control space 134 that surrounds at least a portion of the electrical contact 125. The impedance-control space 134 may comprise an air dielectric and be sized and shaped relative to other components and features of the electrical connector 100 to control impedance. The impedance-control space 134 may be sized and shaped to obtain a predetermined impedance for the electrical connector 100. The predetermined impedance may be substantially 75 ohms or, alternatively, substantially 50 ohms. For example, the predetermined impedance may be between about 68 ohms and 82 ohms or, more particularly, between about 72 ohms and 78 ohms. In other embodiments, the predetermined impedance may be between about 43 ohms and 57 ohms or more particularly, between about 47 ohms and 53 ohms.

The electrical contact 125 may be inserted into and through the contact bore 132 after the insert 112 is positioned within the housing cavity 105 of the connector housing 102. In other embodiments, the electrical contact 125 is inserted into and through the contact bore 132 such that the contact sub-assembly 130 is constructed outside the housing cavity 105. The contact sub-assembly 130 may then be inserted into the housing cavity 105. During operation, the insert 112 is held within, the connector housing 102. The insert 112 may be coupled to the connector housing 102. The insert 112 may be coupled through one or more fastening mechanisms. For example, the insert 112 may form an interference fit with the connector housing 102. Alternatively or in addition to, the insert 112 or the connector housing 102 may have an adhesive coated along or through portions of the insert 112 or the connector housing 102. Furthermore, the insert 112 may be coupled to, for example, the connector housing 102 through a staking operation where a portion of the connector housing 102 is displaced into the insert 112.

The electrical connector 100 may be a pluggable connector such that the connector housing 102 may be configured to be handheld by an individual and removably coupled to the coupling connector 300. More specifically, the electrical connector 100 may be readily separated from or engaged to the coupling connector 300 without undue effort and without destruction or damage of the electrical connector 100 and the coupling connector 300. In some embodiments, the electrical connector 100 is operably coupled to a coaxial cable (not shown). In particular embodiments, the electrical connector 100 is a Bayonet Neill-Concelman (BNC)-type connector configured for having an impedance that is substantially 50 ohms or substantially 75 ohms. More particularly, the electrical connector 100 may be a BNC-jack connector that engages a BNC-plug connector. For example, the connector housing 102 and the insert 112 may be configured to engage a BNC-type plug connector.

Figure 2:
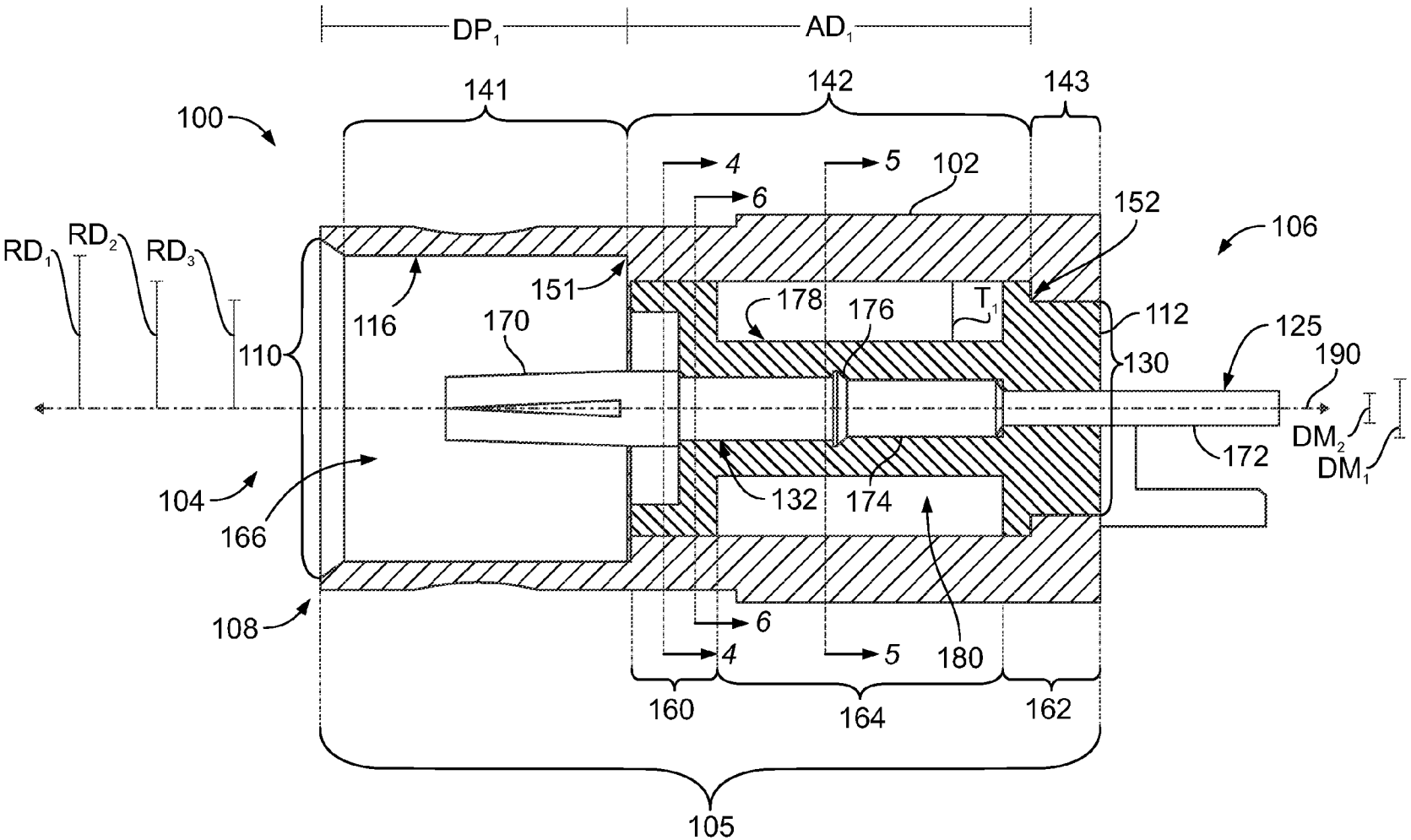
FIG. 2 illustrates a side cross-section of the electrical connector shown in FIG. 1.

FIG. 2 illustrates a side cross-section of the electrical connector 100. As shown, the interior surface 116 of the connector housing 102 defines the housing cavity 105. The interior surface 116 may be shaped to have various features or elements. For example, the interior surface 116 may be shaped to hold the insert 112 within the housing cavity 105. Furthermore, the interior surface 116 may have dimensions that facilitate obtaining the predetermined impedance.

The connector housing 102 may include housing levels 141-143 in the housing cavity 105. The housing levels 141-143 may extend in an axial direction and have different radial distances from the central axis 190. In the illustrated embodiment, the connector housing 102 has a first housing level 141 that is located a radial distance $RD_1$ from the central axis 190; a second housing level 142 that is located a radial distance $RD_2$ from the central axis 190; and a third housing level 143 that is located a radial distance $RD_3$ from the central axis 190.

The housing level 141 may extend from the leading edge 108 to a first step 151 located a depth $DP_1$ within the housing cavity 105. The depth $DP_1$ is measured along the central axis 190. The interior surface 116 extends radially inward toward the central axis 190 at the first step 151 and to the housing level 142. The housing level 142 extends an axial distance $AD_1$ from the step 151 to a second step 152. At the second step 152, the interior surface 116 extends radially inward toward the central axis 190 and to the housing level 143. In the illustrated embodiment, the interior surface 116 along the housing levels 141-143 extends substantially parallel to the central axis 190 such that the corresponding radial distances are substantially uniform throughout the respective housing level. However, in alternative embodiments, the housing levels 141-143 do not extend entirely parallel to the central axis 190, but may have curves or features that change a contour of the respective housing level.

As shown in FIG. 2, the insert 112 (or the contact subassembly 130) includes an engagement end 160, a back end 162, and an intermediate portion 164 that extends between the engagement and back ends 160 and 162. The housing levels 141-143 may be configured to hold the insert 112 within the housing cavity 105 and/or to obtain the predetermined impedance. For example, the second step 152 may function as a positive stop that engages the back end 162 of the insert 112 and prevents the insert 112 from moving further along the central axis 190 through the housing cavity 105. Moreover, the housing, level 142 may be configured along with the insert 112 for the predetermined impedance. As shown, the housing level 142 may surround a majority of the insert 112 (e.g., the engagement end 160 and the intermediate portion 164) and the step 151 may occur at an axial position where the engagement end 160 of the insert 112 is substantially located. The engagement end 160 may be located the depth $DP_1$ within the housing cavity 105.

The insert 112 and the opening 110 may define a jack-reception space 166 that is sized and shaped to receive a plug body 304 (shown in FIG. 3) of the coupling connector 300. In some embodiments, the engagement end 160 of the insert 112 and the opening 110 may define the jack-reception space 166 therebetween. The electrical contact 125 may be disposed in the jack-reception space 166.

The electrical contact 125 may be shaped to form an interference fit with the dielectric material of the insert 112 when the electrical contact 125 is inserted into the contact bore 132. The electrical contact 125 may include a socket 170 that is configured to engage a mating contact 302 (shown in FIG. 3) of the coupling connector 300. The electrical contact 125 may also include a tail portion 172 that is located proximate to the terminating end 106 and may be configured to engage a printed circuit board, a communication cable, BNC adapter, or any other connector/adapter or combination thereof (not shown). The electrical contact may also include a body portion 174 that extends between and joins the socket 170 and the tail portion 172. The body portion 174 may have a diameter $DM_1$ and the tail portion 172 may have a diameter $DM_2$. In the illustrated embodiment, the diameter $DM_1$ is greater than the diameter $DM_2$. As shown, the insert 112 may be shaped so that the contact bore 132 has a reduced size at the back end 162 to prevent the electrical contact 125 from moving through the contact bore 132. The electrical contact 125 may also include a grip element 176 that is configured to prevent or resist the electrical contact 125 from being withdrawn from the contact bore 132 in a direction along the central axis 190 toward the mating end 104.

The insert 112 has an outer surface 178 that faces radially away from the central axis 190 and toward the interior surface 116 of the connector housing 102. As shown, the outer surface 178 along the intermediate portion 164 faces and is spaced apart from the interior surface 116 along the housing level 142. A second impedance-control space 180 comprising an air dielectric may exist between the intermediate portion 164 and the housing level 142. A shape of the impedance-control space 180 may be defined by the insert 112 and the connector housing 102. The impedance-control space 180 may extend completely around the insert 112 and the central axis 190. In the illustrated embodiment, the shape of the impedance-control space 180 is substantially cylindrical or collar-like. The impedance-control space 180 may have a thickness $T_1$ that is measured in a radial direction (i.e., along a radial line that is orthogonal to the central axis 190). In the illustrated embodiment, the thickness $T_1$ measured between the interior surface 116 and the outer surface 178 may be substantially uniform throughout. Moreover, the impedance-control space 180 may be sized and shaped to facilitate obtaining the predetermined impedance.

Figure 3:
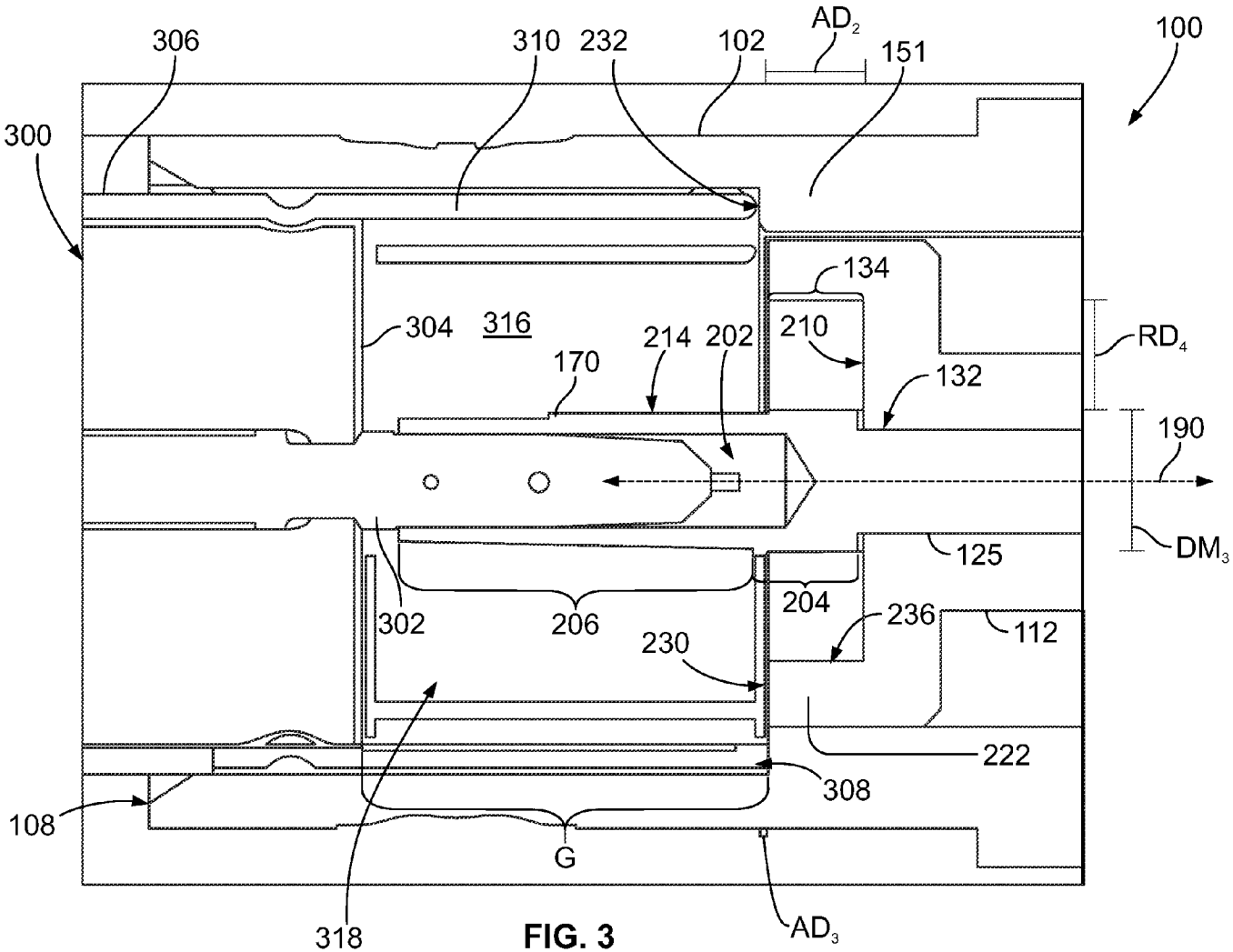
FIG. 3 illustrates an enlarged portion of the side cross-section of the electrical connector shown in FIG. 2 when the electrical connector is mated with a coupling connector.

FIG. 3 is an enlarged portion of the side cross-section shown in FIG. 2 of the electrical connector 100 when the electrical connector 100 is mated with the coupling connector 300. As shown, the coupling connector 300 includes a connector housing 306 that holds a plug body 304 having a mating contact 302 disposed therein. The connector housing 306 may be configured to couple to the connector housing 102 when the connector housing 306 is inserted into the housing cavity 105 (FIG. 2) of the connector housing 102. The connector housing 306 has a sidewall 310 that includes a leading edge 308. The sidewall 310 has an interior surface 316 that defines a housing cavity 318 of the connector housing 306. The mating contact 302 is configured to engage the electrical contact 125. In the illustrated embodiment, the mating contact 302 forms a pin contact and the electrical contact 125 forms a socket contact having a mating bore 202 that is sized and shaped to receive and engage the mating contact 302. Also shown, when the electrical and coupling connectors 100 and 300 are mated, a gap G may exist between the plug body 304 and the insert 112 of the electrical connector 100.

The socket 170 of the electrical contact 125 may include a base portion 204 and a distal tip 206. The base portion 204 may project beyond a recess surface 210 of the insert 112 toward the mating end 104 (FIG. 1) and toward the distal tip 206. The base portion 204 may have a diameter $DM_3$ that is greater than the diameter $DM_1$ (FIG. 2) of the body portion 174 (FIG. 2) and greater than an opening to the contact bore 132. Accordingly, the base portion 204 may grip the recess surface 210. Also shown, the diameter $DM_3$ of the base portion 204 may taper or reduce as the socket 170 extends toward the distal tip 206. Furthermore, the socket 170 may have an outer surface 214 that faces radially away from the central axis 190 toward the interior surface 316 of the connector housing 306 or a radially-inward surface 236 of the insert 112.

Also shown in FIG. 3, the insert 112 has the recess surface 210 that faces the mating end 104 and extends a radial distance $RD_4$ outward from the electrical contact 125. The insert 112 also includes a dielectric rim 222 that projects from the recess surface 210 toward the mating end 104. The dielectric rim 222 surrounds and is radially spaced from at least a portion of the electrical contact 125. The dielectric rim 222 may have a rim surface 230 that faces the mating end 104. The dielectric rim 222 may extend an axial distance $AD_2$ from the recess surface 210 to the rim surface 230. In particular embodiments, the rim surface 230 may be offset with respect to a step surface 232 of the first step 151 such that the rim surface 230 is located an axial distance $AD_3$ further into the housing cavity 105 from the leading edge 108. The step surface 232 may be a portion of the interior surface 116 (FIG. 1) of the connector housing 102. The step surface 232 may engage the leading edge 308 of the connector housing 306 to prevent the connector housing 306 from advancing further into the housing cavity 105. In alternative embodiments, the rim surface 230 may be substantially flush with the step surface 232 of the first step 151 such that the step surface 232 and the rim surface 230 are coplanar. In other embodiments, the rim surface 230 may be offset with respect to the step surface 232 such that the rim surface 230 projects beyond the step surface 232 at a position closer to the leading edge 108.

The dielectric rim 222 and the recess surface 210 may define the impedance-control space 134 that surrounds at least a portion of the electrical contact 125. For example, the dielectric rim 222 may define an outer periphery of the impedance-control space 134. The impedance-control space 134 may comprise an air dielectric and may open to the gap G (or the jack-reception space 166 shown in FIG. 2). The impedance-control space 134 may surround only a portion of the electrical contact 125. For example, the impedance-control space 134 may surround the base portion 204 of the socket 170. However, in alternative embodiments, the impedance-control space 134 may surround the entire socket 170.

In particular embodiments, the impedance control space 134 is substantially disk-shaped. The radial distance $RD_4$ that extends from the socket 170 to the radially-inward facing surface 236 of the dielectric rim 222 may be substantially uniform about the central axis 190. However, in alternative embodiments, the radial distance $RD_4$ may not be substantially uniform. The dielectric rim 222 may have features along the radially-inward facing surface 236 that change (e.g., increase or decrease) the radial distance $RD_4$. As such, in alternative embodiments, the impedance-control space 134 may have other shapes, such as being block-shaped-(rectangular or square) or other three-dimensional shapes as desired.

Figure 4:
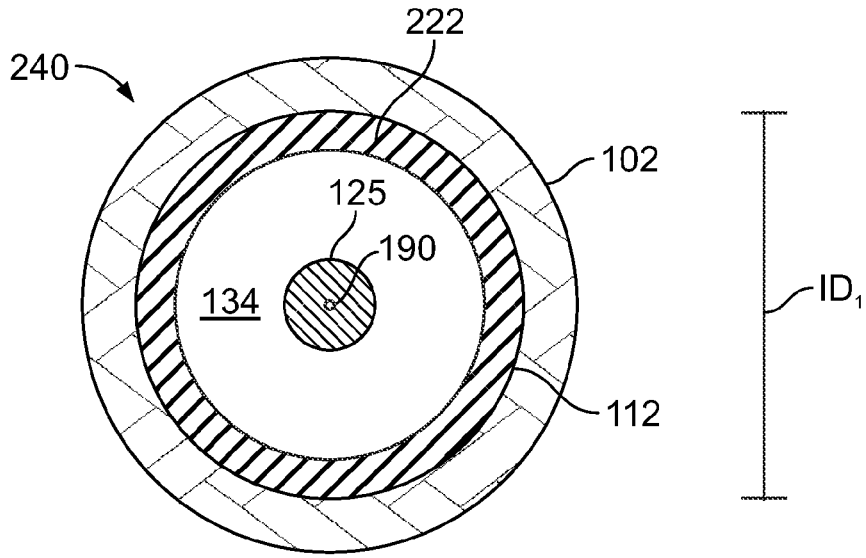
FIG. 4 is a first cross-section of the electrical connector taken along the line 4-4 shown in FIG. 2.
Figure 5:
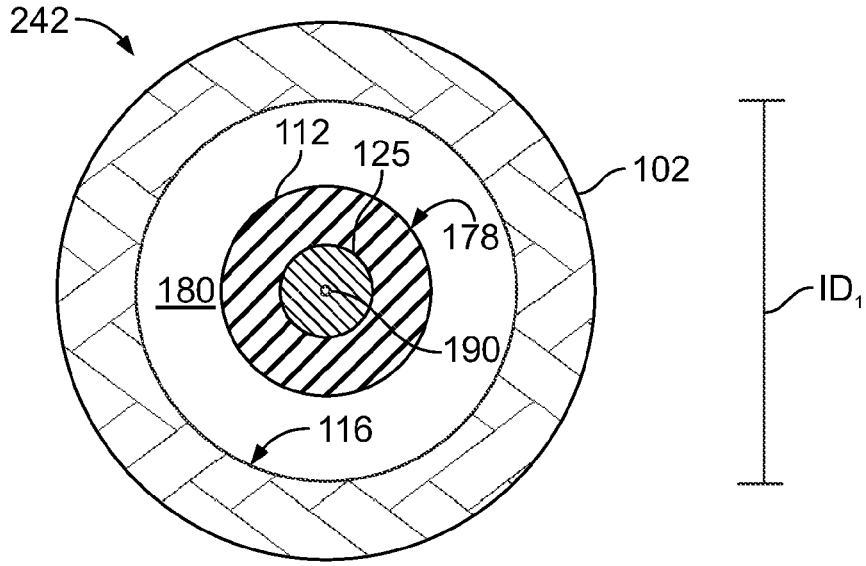
FIG. 5 is a second cross-section of the electrical connector taken along the line 5-5 shown in FIG. 2.
Figure 6:
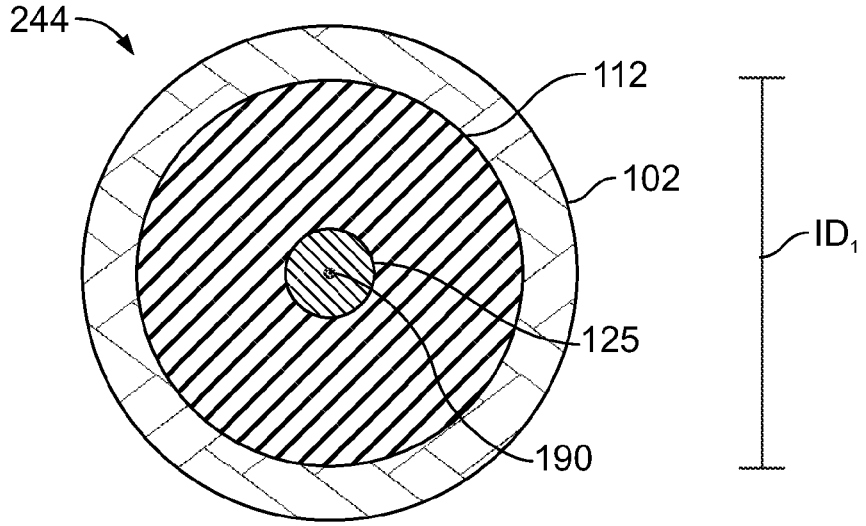
FIG. 6 is a third cross-section of the electrical connector taken along the line 6-6 shown in FIG. 2.

FIGS. 4-6 illustrate different cross-sections taken perpendicular to the central axis 190 of the electrical connector 100 as shown in FIG. 4. More specifically, FIGS. 4-6 illustrate cross-sections of the contact sub-assembly 130 (FIG. 2) and the connector housing 102. FIG. 4 is a first cross-section 240 taken perpendicular to the central axis 190 at the engagement end 160 (FIG. 2). FIG. 5 is a second cross-section 242 taken perpendicular to the central axis 190 at the intermediate portion 164 (FIG. 2). FIG. 6 is a third cross-section 244 taken perpendicular to the central axis 190 at the engagement end 160 (FIG. 2) and a location that is between the first and second cross-sections 240 and 242. As shown in FIGS. 4-6, the electrical connector 100 may utilize the impedance-control spaces 134 (FIG. 4) and 180 (FIG. 5) that each include an air dielectric. The air dielectrics may immediately surround the electrical contact 125 or the insert 112 to facilitate controlling or obtaining the predetermined impedance. The electrical connector 100 may transition from the first cross-section 240 (FIG. 4) in which the air dielectric of the impedance-control space 134 immediately surrounds the electrical contact 125 to the second cross-section 242 (FIG. 5) in which the dielectric material of the insert 112 immediately surrounds the electrical contact 125.

With respect to FIG. 4, the electrical contact 125 is immediately surrounded by the impedance-control space 134 at the engagement end 160 (FIG. 2) such that no other material exists between the electrical contact 125 and the impedance-control space 134. The electrical contact 125 and the dielectric rim 222 are separated by the air dielectric of the impedance-control space 134. As shown in FIG. 4, the connector housing 102, the insert 112, the impedance-control space 134, and the electrical contact 125 are substantially concentric with respect to the central axis 190. In the illustrated embodiment, the connector housing 102 immediately surrounds the dielectric rim 222 such that no other material or components exist therebetween. However, the connector housing 102 may still immediately surround the dielectric rim 222 if manufacturing tolerances result in a small space existing between the connector housing 102 and the dielectric rim 222. The connector housing 102 may also have an inner diameter $ID_1$ that extends perpendicular to and is measured through the central axis 190 between different portions of the interior surface 116 (FIG. 2).

As shown in the cross-section 242 in FIG. 5, the electrical contact 125 is immediately surrounded by the insert 112 such that no other material or components exist therebetween. However, a small spacing may exist due to manufacturing tolerances. The outer surface 178 of the insert 112 along the intermediate portion 164 (FIG. 2) may be immediately surrounded by the impedance-control space 180. In addition, the connector housing 102 may also have the inner diameter $ID_1$ that extends perpendicular, to and is measured through the central axis 190 between different portions of the interior surface 116. The inner diameter $ID_1$ may be substantially equal at the first and second cross-sections 240 (FIGS. 4) and 242.

As shown in FIG. 6, the cross-section 244 of the connector housing 102 and the contact sub-assembly 130 (FIG. 2) does not include an air dielectric. The dielectric material of the insert 112 immediately surrounds the electrical contact 125. The connector housing 102 immediately surrounds the insert 112. Furthermore, the connector housing 102 may also have the inner diameter $ID_1$ at the cross-section 244 and, as such, the inner diameter $ID_1$ may be substantially equal at the first, second, and third cross-sections 240, 242, and 244. Moreover, in the illustrated embodiment, the insert 112 and the connector housing 102 may be substantially circular about the central axis 190 for each of the first, second, and third cross-sections 240, 242, and 244.

Thus, to control or obtain the predetermined impedance, the electrical connector 100 may comprise different cross-sections taken perpendicular (or orthogonal) to the central axis. The different cross-sections may have different configurations, dimensions, spacings, and/or relationships with respect to the air dielectrics of the impedance-control spaces 134 and 180, the housing material of the connector housing 102, the dielectric material of the insert 112, and the electrical contact 125. Accordingly, as shown in FIGS. 4-6, the contact sub-assembly 130 transitions from the cross-section 240 to the cross-section 242. In the cross-section 240 the electrical contact 125 is immediately surrounded by the air dielectric of the impedance-control space 134 that is, in turn, immediately surrounded by the dielectric material of the insert 112. In the cross-section 242, the electrical contact 125 is immediately surrounded by the dielectric material of the insert 112 that is, in turn, immediately surrounded by the air dielectric of the impedance-control space 180. The contact sub-assembly 130 may transition from the first cross-section 240 to the second cross-section 242 through a region or portion that does not have an air dielectric, such as shown in the cross-section 244. Moreover, in the illustrated embodiment, the inner diameter $ID_1$ of the connector housing 102 is constant through the cross-sections 240, 242 and 244.

Figure 7:
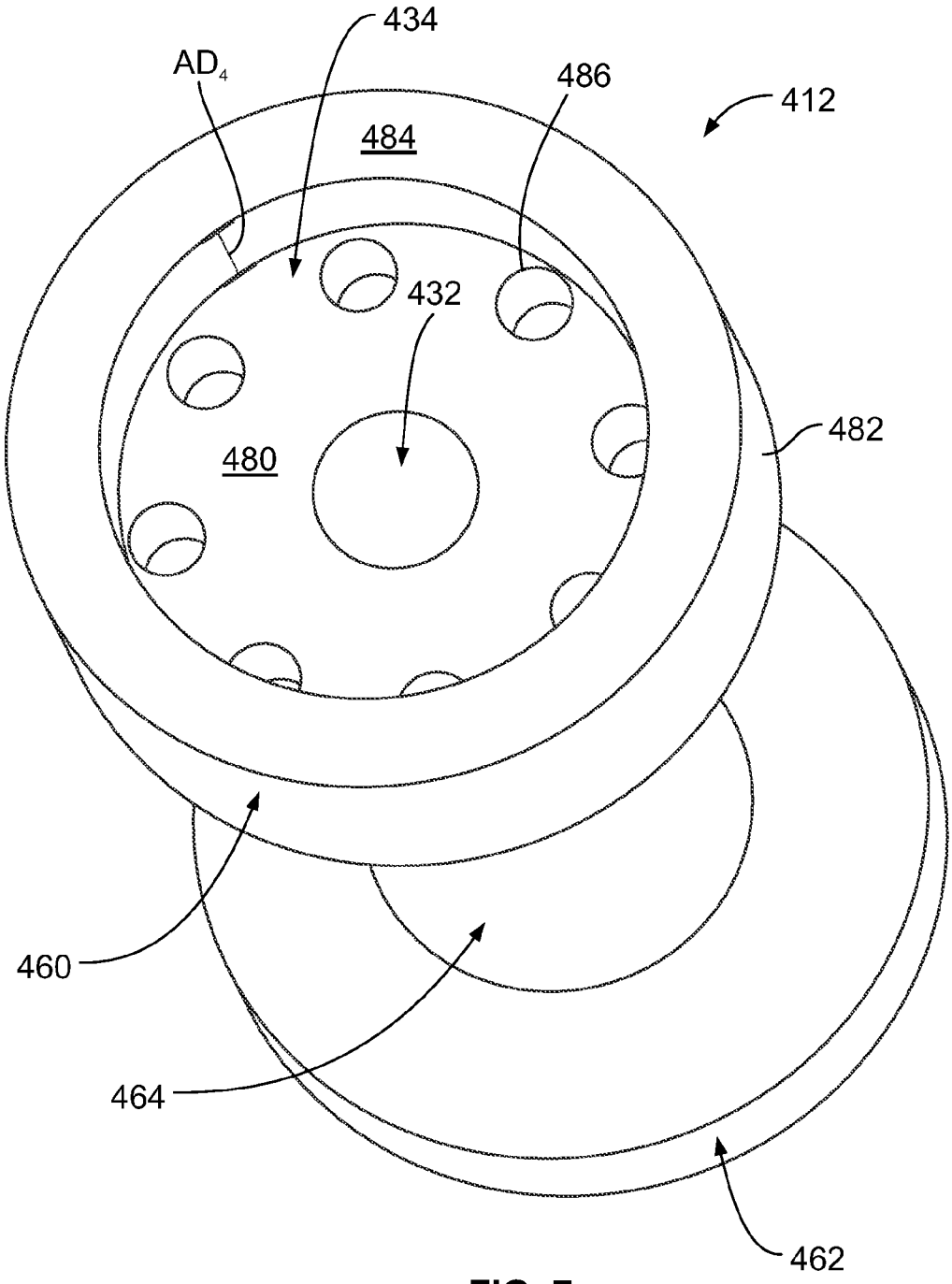
FIG. 7 is an isolated perspective view of a dielectric insert that may be used with an electrical connector in accordance with another embodiment.
Figure 8:
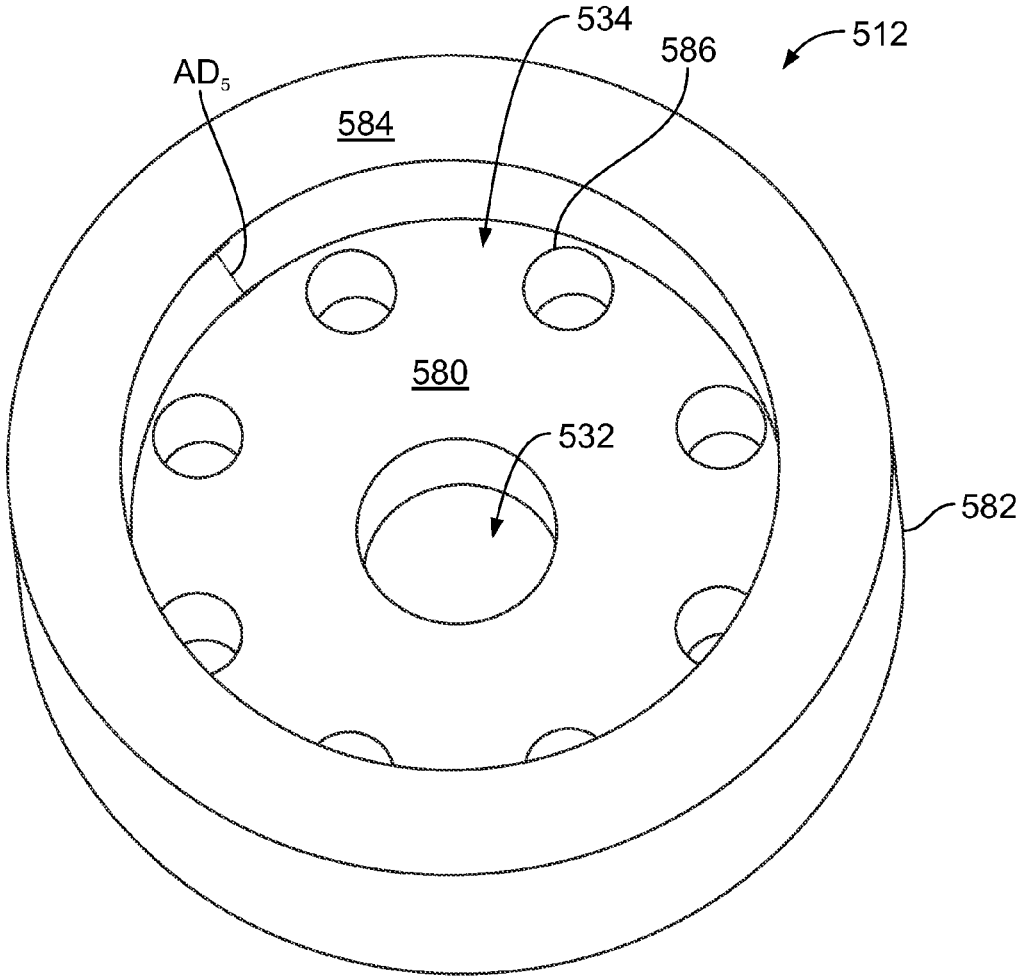
FIG. 8 is an isolated perspective view of a dielectric insert that may be used with an electrical connector in accordance with another embodiment.

FIGS. 7 and 8 illustrate isolated perspective views of dielectric inserts 412 and 512, respectively. The dielectric inserts 412 and 512 may be used with electrical connectors similar to the electrical connector 100 (FIG. 1). More specifically, the inserts 412 and 512 comprise dielectric material and may be positioned within housing cavities of connector housings that are similar to the connector housing 102 (FIG. 1). With respect to FIG. 7, the insert 412 has similar dimensions and features as the insert 112 shown in FIG. 1 and is configured to hold an electrical contact (not shown). The insert 412 includes an engagement end 460, a back end 462, and an intermediate portion 464 that extends therebetween. A contact bore 432 may extend through a center of the insert 412 to allow the electrical contact to be positioned therein.

The insert 412 includes a first impedance-control space 434 that is substantially disk-shaped. The insert 412 has a recess surface 480 that extends a radial distance outward from the contact bore 432 (and the electrical contact when the electrical contact is disposed therein). The insert 412 also includes a dielectric rim 482 that projects from the recess surface 480. When the electrical contact is disposed within the contact bore 432, the dielectric rim 482 surrounds and is radially spaced from at least a portion of the electrical contact. The dielectric rim 482 may have a rim surface 484 that faces in generally a common direction with respect to the recess surface 480. The dielectric rim 482 may extend an axial distance $AD_4$ from the recess surface 480 to the rim surface 484. In the illustrated embodiment, the electrical contact would be immediately surrounded by the insert 412 such that no other material or components exist therebetween. The dielectric rim 482 and the recess surface 480 may define the impedance-control space 434 that would surround at least a portion of the electrical contact.

Also shown in FIG. 7, the insert 412 may include a plurality of impedance-control holes 486 distributed about the contact bore 432. The holes 486 may provide air dielectrics configured to control the impedance of the corresponding electrical connector. In particular embodiments, the holes 486 are evenly distributed about the contact bore 432 such that spacings between adjacent holes 486 are substantially equal and the holes 486 are located a common radial distance from the contact bore 432. Furthermore, in the illustrated embodiment, the holes 486 may extend from the recess surface 480 completely through the engagement end 460 of the insert 412 so that the impedance-control space 434 is in fluid communication with an impedance-control space that surrounds the intermediate portion 464. (The impedance-control space surrounding the intermediate portion 464 may be similar to the impedance-control space 180 that surrounds the intermediate portion 164 in FIG. 2.)

Turning to FIG. 8, the insert 512 may be similarly sized and shaped and include similar features as the engagement end 460 shown in FIG. 7. The insert 512 may be used, for examples, in electrical connectors that have housing cavities with limited axial space. In addition, the insert 512 may be used in combination with other dielectric bodies. For example, in such embodiments the insert 512 may be positioned side-by-side or adjacent to another dielectric body to form a dielectric insert that is similar to the insert 112 (FIG. 1). As shown, the insert 512 includes a first impedance-control space 534 that is substantially disk-shaped. The insert 512 has a recess surface 580 that extends a radial distance outward from a contact bore 532. The contact bore 532 is configured to receive an electrical contact (not shown) therethrough. The insert 512 also includes a dielectric rim 582 that projects from the recess surface 580. When the electrical contact is disposed within the contact bore 532, the dielectric rim 582 surrounds and is radially spaced from at least a portion of the electrical contact. The dielectric rim 582 may have a rim surface 584 that faces in generally a common direction with respect to the recess surface 580. The dielectric rim 582 may extend an axial, distance $AD_5$ from the recess surface 580 to the rim surface 584. The dielectric rim 582 and the recess surface 580 may define the impedance-control space 534 that would surround at least a portion of the electrical contact. Similar to the dielectric insert 412, the insert 512 may include a plurality of impedance-control holes 586 distributed about the contact bore 532. In particular embodiments, the holes 586 are evenly distributed about the contact bore 532. Furthermore, in the illustrated embodiment, the holes 586 may extend from the recess surface 580 completely through the insert 512.

It is to be understood that the above description is intended to be illustrative, and not restrictive. In addition, the above-described embodiments (and/or aspects or features thereof) may be used in combination with each other. Furthermore, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and, are not intended to be interpreted based on 35 U.S.C. §112 sixth paragraph, unless and until such claim limitations expressly use the phrase "means for" followed by a statement of function void of further structure.

What is claimed is:

1. An electrical connector comprising:

a connector housing having mating and terminating ends, the connector housing having a housing cavity and a leading edge at the mating end that defines an opening to the housing cavity, wherein a central axis extends through the housing cavity between the mating and terminating ends, the connector housing forming an internal step that extends radially toward the central axis in the housing cavity, the internal step having a step surface that faces toward the mating end;

a dielectric insert positioned within the housing cavity, the insert having an engagement end, a back end, and an intermediate portion extending therebetween; and an electrical contact held by the insert along the central axis and configured to engage a coupling connector in the housing cavity;

wherein the insert has a recess surface that faces the mating end and extends a radial distance outward from the electrical contact, the insert including a dielectric rim at the engagement end that projects an axial distance from the recess surface toward the mating end, the dielectric rim surrounding and being radially spaced from the electrical contact, the dielectric rim and the recess surface defining an impedance-control space that circumferentially surrounds the electrical contact about the central axis, wherein the axial distance of the dielectric rim and the radial distance of the recess surface are sized to obtain a target impedance for the electrical connector;

wherein the dielectric insert is sized and shaped to be inserted through the opening in a direction that is from the mating end to the terminating end in order to position the insert at an operative location, the step surface of the connector housing directly engaging the back end of the insert to positively stop the insert at the operative location.

2. The electrical connector in accordance with claim 1, wherein the dielectric rim defines an outer periphery of the impedance-control space.

3. The electrical connector in accordance with claim 1, wherein the impedance-control space has a substantially disk-like shape.

4. The electrical connector in accordance with claim 1, wherein the electrical contact comprises a base portion that projects beyond the recess surface toward the mating end, the base portion having a surface that is exposed to the impedance-control space, the impedance-control space being defined by the dielectric rim, the recess surface, and the exposed surface of the base portion.

5. The electrical connector in accordance with claim 1, wherein the electrical contact comprises a socket contact having a mating bore configured to receive a mating contact from the coupling connector.

6. The electrical connector in accordance with claim 1, wherein the target impedance is between about 72 ohms and about 78 ohms.

7. The electrical connector in accordance with claim 1, wherein the insert and the electrical contact form a contact sub-assembly, wherein a cross-section of the contact sub-assembly taken perpendicular to the central axis at the engagement end is configured for the target impedance, the electrical contact being immediately surrounded by the impedance-control space at the engagement end, the impedance-control space being surrounded and defined by the dielectric rim and the electrical contact.

8. The electrical connector of claim 1, wherein the dielectric rim has a thickness measured perpendicular to the central axis, the thickness being less than the axial distance of the dielectric rim along the central axis.

9. The electrical connector of claim 1, wherein the back end is proximate to the terminating end of the connector housing and the intermediate portion extends continuously between and joins the engagement and back ends, the impedance-control space being a first impedance-control space, wherein the insert and the connector housing define a second impedance-control space, the second impedance-control space extending radially from an outer surface of the intermediate portion to an interior surface of the connector housing and extending longitudinally between the engagement and back ends.

10. The electrical connector of claim 1, wherein the electrical contact clears the back end and projects therefrom.

11. The electrical connector of claim 1, wherein the back end is substantially flush with the terminating end of the connector housing.

12. The electrical connector of claim 1, wherein the connector housing has a length that is measured from the mating end to the terminating end, the insert being a single continuous element that extends along for greater than half the length.

13. An electrical connector comprising:

a connector housing having mating and terminating ends, the connector housing having a leading edge that defines an opening at the mating end that leads into a housing cavity, a central axis extending through the housing cavity between the mating and terminating ends, wherein the connector housing has an interior surface that faces radially-inward toward the central axis, the interior surface defining a first housing section that extends from the leading edge to a front step and a second housing section that extends from the front step toward the terminating end of the connector housing, the front step extending radially inward from an end of the first housing section to the second housing section;

a contact sub-assembly disposed within the housing cavity, the contact sub-assembly including a dielectric insert comprising a dielectric material and an electrical contact held by the insert along the central axis, the insert having an engagement end configured to interface with a coupling connector, the engagement end being surrounded by the second housing section, the electrical contact projecting beyond the insert at the engagement end, the insert also including a back end that is proximate to the terminating end of the connector housing and an intermediate portion that extends continuously between and joins the engagement and back ends, each of the engagement end, the back end, and the intermediate portion having an outer diameter that is measured perpendicular to the central axis, the outer diameter of the intermediate portion being less than each of the outer diameters of the engagement end and the back end;

wherein a cross-section of the contact sub-assembly and the connector housing taken perpendicular to the central axis at the engagement end is configured for a target impedance, the electrical contact being immediately surrounded by an impedance-control space at the engagement end, the impedance-control space being surrounded and defined by the dielectric material of the insert, the impedance-control space extending an axial distance along the central axis and a radial distance from the electrical contact to a portion of the insert, the axial and radial distances being sized to obtain the target impedance for the electrical connector.

14. The electrical connector in accordance with claim 13, wherein the cross-section is a first cross-section and the contact sub-assembly and the connector housing have a second cross-section taken perpendicular to the central axis at a substantially middle location between the engagement end and the back end, the electrical contact being immediately surrounded by the dielectric material of the insert in the second cross-section, the dielectric material in the second cross-section being immediately surrounded by an air dielectric in the housing cavity, the air dielectric being immediately surrounded by an interior surface of the connector housing.

15. The electrical connector in accordance with claim 14, wherein the contact-subassembly and the connector housing have a third cross-section taken perpendicular to the central axis at a location that is between the first and second cross-sections, the electrical contact being immediately surrounded by the dielectric material of the insert in the third cross-section, the dielectric material in the third cross-section being immediately surrounded by the connector housing.

16. The electrical connector in accordance with claim 13, wherein the insert and the opening to the housing cavity define a jack-reception space therebetween that is configured to receive a portion of the coupling connector.

17. The electrical connector in accordance with claim 13, wherein the electrical contact comprises a socket contact having a mating bore configured to receive a mating contact from the coupling connector.

18. The electrical connector in accordance with claim 13, wherein the engagement end of the insert is immediately surrounded by the interior surface of the connector housing along the second housing section such that the interior surface along the second housing section engages the engagement end.

19. The electrical connector in accordance with claim 13, wherein the target impedance is between about 72 ohms and about 78 ohms.

20. The electrical connector of claim 13, wherein the dielectric rim has a rim surface that faces the mating end and is approximately flush with the front step.

21. An electrical connector comprising:

a connector housing having mating and terminating ends, the connector housing having a housing cavity and a leading edge at the mating end that defines an opening to the housing cavity, wherein a central axis extends through the housing cavity between the mating and terminating ends;

a dielectric insert positioned within the housing cavity; and an electrical contact held by the insert along the central axis and configured to engage a coupling connector in the housing cavity;

wherein the insert has a recess surface that faces the mating end and extends a radial distance outward from the electrical contact, the insert including a dielectric rim that projects an axial distance from the recess surface toward the mating end, the dielectric rim surrounding and being radially spaced from the electrical contact, the dielectric rim and the recess surface defining an impedance-control space that circumferentially surrounds the electrical contact about the central axis, wherein the axial distance of the dielectric rim and the radial distance of the recess surface are sized to obtain a target impedance for the electrical connector;

wherein the dielectric insert is sized and shaped to be inserted through the opening in a direction that is from the mating end to the terminating end in order to position the insert at an operative location;

wherein the insert has an engagement end that includes the dielectric rim, a back end that is proximate to the terminating end of the connector housing, and an intermediate portion that extends continuously between and joins the engagement and back ends, each of the engagement end, the back end, and the intermediate portion having an outer diameter that is measured perpendicular to the central axis, the outer diameter of the intermediate portion being less than the outer diameters of the engagement end and the back end.

* * * * *